United States Patent [19]

D'Antonio et al.

[11] 4,130,296

[45] Dec. 19, 1978

[54] SKI-BINDING

[75] Inventors: Nicholas F. D'Antonio, Liverpool; Richard L. Bates, Camillus, both of N.Y.

[73] Assignee: Kinetronic Industries, Media, Pa.

[21] Appl. No.: 701,301

[22] Filed: Jun. 30, 1976

[51] Int. Cl.[2] ..... A63C 9/08

[52] U.S. Cl. ..... 280/612; 280/607; 280/617; 280/623; 280/636

[58] Field of Search ..... 280/618, 617, 616, 623, 280/613, 612, 611, 607, 636

[56] References Cited

U.S. PATENT DOCUMENTS

| | | | |
|---|---|---|---|
| Re. 26,972 | 10/1970 | Spademan | 280/624 |
| 2,196,925 | 4/1940 | Kairis | 280/607 |
| 2,950,118 | 8/1960 | Sharpe | 280/611 X |
| 3,061,325 | 10/1962 | Glass | 280/613 |
| 3,367,672 | 2/1968 | Tonozzi et al. | 280/612 |
| 3,892,980 | 7/1975 | Anderson | 280/612 X |

FOREIGN PATENT DOCUMENTS

| | | | |
|---|---|---|---|
| 173073 | 11/1952 | Austria | 280/623 |
| 535818 | 10/1931 | Fed. Rep. of Germany | 280/636 |
| 36767 | 4/1906 | Switzerland | 280/636 |

*Primary Examiner*—Joseph F. Peters, Jr.
*Assistant Examiner*—Milton L. Smith
*Attorney, Agent, or Firm*—D. Peter Hochberg

[57] ABSTRACT

A ski binding for releasably securing a ski boot to a ski and for releasing the ski boot upon the application of predetermined forces to the boot, the ski binding comprising a boot engaging member movable in a linear path between a boot engaging position and a releasing position, apparatus for biasing the boot engaging member towards the releasing position, a latching mechanism for retaining the boot engaging member in the boot engaging position, and an unlatching mechanism for deactivating the latching mechanism in response to the application of the predetermined forces to the ski boot to free the biasing means to drive the boot engaging member to the releasing position.

37 Claims, 13 Drawing Figures

SKI-BINDING

BACKGROUND OF THE INVENTION

1. Field of the Invention

The present invention relates to ski bindings for automatically releasing a retained ski boot from a ski in response to the application of forces to the ski boot which could cause injury to the skier were the skier to remain mounted on the ski.

2. Description of the Prior Art

A great variety of ski bindings have been developed for securing a skier's respective ski boots to a pair of skis. In its simpler form, a ski binding provides means for strapping the ski boot to a ski to retain the skier mounted on the ski during a ski run. Because of the substantial likelihood of injuries to skiers resulting from twists, turns and falls wherein the skier remained mounted on the ski, there have been developed over the years a great number of safety bindings for releasing a retained ski boot from a ski in the event that forces applied to the ski boot exceeded a level anticipated as causing injury to the skier unless the skier were released from the ski. Such safety bindings have become quite sophisticated in recent years in light of the great popularity of skiing, and careful studies made of the operation of ski bindings and the causes of ski-related injuries to skiers.

One type of known safety binding is referred to as a cable binding. Cable bindings include cables connected at the forward end of a ski and forming a free loop extending rearwardly of a retained ski boot. The cable is drawn tightly against the heel portion of a ski boot in the binding, and a latch to which the cable is attached retains the cable against the boot. In the event that high forces are applied to the ski boot, means are provided for releasing the tension of the cable against the ski boot, whereby the boot can slip out of the binding and release the skier from the ski. Another type of safety binding includes heel and toe members mounted on a ski for engaging heel and toe portions of the ski boot to retain the boot on the ski. In general, the latter type of bindings includes means for latching either the toe or heel members in place in firm engagement with a ski boot disposed in the ski binding. When forces anticipated as being sufficient to cause injury to the skier occur, means are provided for unlatching the latched toe or heel member, whereby that member releases its engagement with the ski boot and the boot can slip out of the binding. Some popular bindings incorporating the toe and heel structure are popularly known under the names Cubco, Tyrolia, Marker, Americana, Gertsch, Look Nevada and Salomon.

Another type of binding which has become popular in recent years is a binding which has latching members for engaging structure associated with the sides of a ski boot rather than the toe or heel portion of the boot. This type of binding is described in U.S. Pat. No. Re. 26,972.

Despite the great advances which have been made in the development of ski bindings designed and constructed to protect skiers from injury, they have not proven entirely satisfactory as evidenced by the tremendous number of ski injuries which occur annually. This is largely due to the fact that existing ski bindings cannot be accurately set to effect the release of a retained ski boot in response to the application of injury-causing forces to the boot. This inaccuracy is, at least in part, caused by the fact that prior ski bindings are not environmentally secure so that ice, moisture and foreign matter frequently become lodged within the operating components of these bindings, thus altering their frictional characteristics and changing their respective release thresholds.

Some forces which are known to cause injury to skiers are not of a type to which present ski bindings respond. For example, forces of small magnitude but relatively long duration are a frequent cause of injury, and occur in the event of slow, twisting falls by skiers. On the other hand, some very high forces which are of very brief duration are not injury-causing forces, these occurring, for example, when a particularly aggressive skier proceeds down a slope taking vigorous turns and jumps in the process. One type of system for effecting release which is fully responsive to the foregoing forces, and indeed to other injury-causing forces as well, would be one incorporating transducers for generating electrical signals responsive to such forces, an electrical circuit for responding to these forces by controlling the operation of a mechanical member such as an electrical solenoid, and a mechanical ski binding for releasing from a cocked condition by such controlling member. However, for the same reason that known ski bindings are often ineffective in use, i.e., their environmental insecurity, known mechanical bindings are not compatible with electrical systems.

Prior safety bindings, including cable bindings, toe-and-heel bindings, and side-latching bindings, involve the pivotal movement of latching members for effecting release. Thus, the latching member swings about a pivot member in opposition to spring forces in order to effect release. An exception to this general statement is the binding described in U.S. Pat. No. 3,061,325 which incorporates latching members movable in a linear path in a recess in the sole of a ski boot. Ski bindings have been suggested incorporating magnetic latching members as well. However, the latter types of bindings have not been accepted by skiers.

SUMMARY OF THE INVENTION

An object of the present invention is to provide an improved ski binding which is not susceptible to malfunction because of deleterious foreign materials.

Another object of the present invention is the provision of an environmentally secure ski binding.

Still another object of the invention is the provision of an improved ski binding in which a skier need merely step into the binding to safely and properly secure a ski boot to the binding.

It is a further object to provide an improved ski binding which is compatible for operation in conjunction with an electronic release system.

A further object of the present invention is to provide an improved ski binding which is compact, and defines a low profile on the surface of a ski.

Yet another object of the present invention is to provide an improved, aesthetic ski binding.

Still another object of the present invention is to provide an improved ski binding which is economical to manufacture, and efficient and effective in use.

Other objects will be apparent from the description to follow and from the appended claims.

The foregoing objects are achieved according to the preferred embodiment of the invention described below, which comprises boot engaging means for engaging a ski boot disposed in the ski binding for releasably securing the boot to the ski, guide means for guiding the boot engaging means in a linear path on the ski between a boot engaging position and a releasing position, biasing means for biasing the boot engaging means towards the releasing position, latching means for latching the boot engaging means in the boot engaging position, and unlatching means for unlatching the boot engaging means from the boot engaging position to effect the release of a retained ski boot from the binding.

DESCRIPTION OF THE PREFERRED EMBODIMENT

The preferred embodiment of the invention described below provides a mechanism for releasably securing a ski boot to a ski, and for releasing the boot upon the application of predetermined forces to the boot. The ski binding described below is a stepin type binding, and is adapted to be cocked by the skier prior to the mounting of a boot in the binding, after which the skier merely steps into the binding to be secured therein. The ski binding has a boot engaging member which is movable in a linear path between a first position wherein the boot engaging member is engaged with the boot to secure it in the binding, and a second position wherein it is disposed away from the boot so that the boot can slip out of the binding. A latch stud is provided for engaging structure associated with the ski boot for retaining the boot in the binding while the boot engaging member is in the first position. The boot engaging member is spring biased towards the second or releasing position, and is maintained in the first position by a toggle mechanism. The toggle mechanism is essentially a linkage which has cocked and uncocked positions. The toggle mechanism is placed in the uncocked position by an electrically actuated solenoid under the control of an electronic release system.

Figure 1:
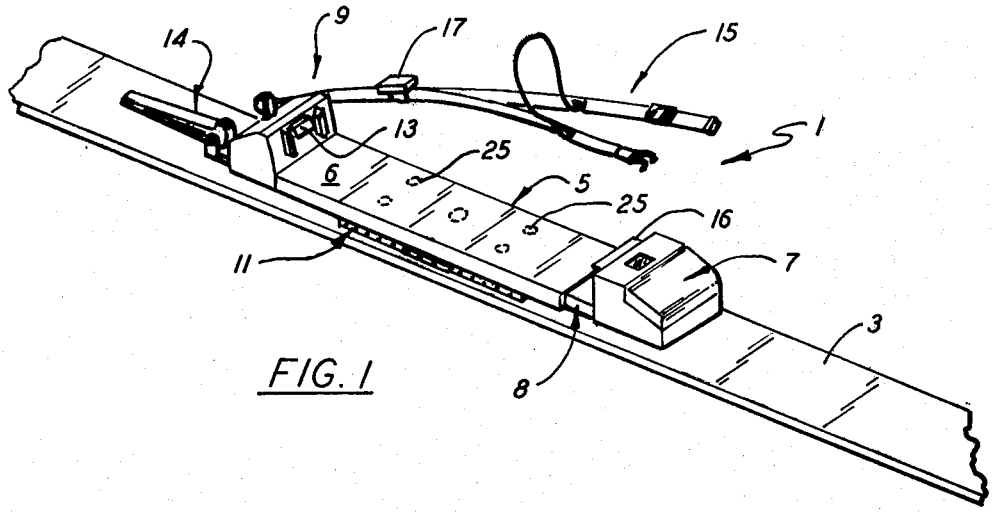
FIG. 1 is a perspective view of a ski binding according to the invention, mounted on a ski.

Referring now to the drawings, there is shown in FIG. 1 a ski binding 1 mounted on a ski 3 by some appropriate means. The ski binding comprises a ski boot support member 5 for receiving a ski boot to be mounted on the ski, a toe retaining member 7 for securing the forward end of the ski boot in ski binding 1, and a heel retaining or boot engaging member 9 mounted at the rearward end of binding 1 for retaining the heel end of the boot in the ski binding. Toe retaining member 7 is fixed on a slide plate 8 which is constructed to slide in a telescoping manner into support member 5, to adjust the distance between members 7 and 9 for the purpose of accommodating ski boots of different sizes. The upper or boot engaging surface 6 of boot support member 5 is resilient and compressible, for enabling the upper toe and heel surfaces of a boot to fit beneath the latch studs described below, despite the presence of snow, ice or dirt on the base of the sole of the boot. Support plate 5, toe retaining member 7 and slide plate 8, and heel retaining member 9 collectively comprise a platform which is mounted on a pedestal assembly 11 and adapted to have its location on ski 3 adjusted on pedestal 11, which is fixed relative to the ski. Heel retaining member 9 includes a heel latching stud 13 which is fixed to the heel retaining member 9 shown in FIG. 1. Stud 13 is secured to the heel retaining member by a pair of shear pins whose function is described hereinafter. A similarly constructed (although larger) toe latching stud 16 is secured by shear pins in toe retaining member 7. Heel retaining member 9 is movable in a linear path between the boot engaging, first, or cocked position shown in FIG. 1, and a second or releasing position rearward of the illustrated position. A cocking lever 14 is provided for cocking heel retaining member 9 on the latter's first position. Toe retaining member 7, on the other end, is mounted on slide plate 8 and is fixed relative to plate 5 when plate 8 is adjusted for a particular size boot. Ski binding 1 further includes a safety strap 15 whose function it is to retain a ski to a skier's ankle about which the strap is secured in the event that the skier's boot is released from the ski binding. It is contemplated that ski binding 1 be under the control of an electrical system, and a battery pack 17 is provided for holding the batteries for powering such system. Appropriate electrical leads connect the batteries in pack 17 to the system. The battery pack could alternately be located in a housing associated with toe retaining member 7, or heel retaining member 9, within support plate 5 or other unobstructive location, such as in the event that "ski stops" are used in place of safety straps.

Figure 2:
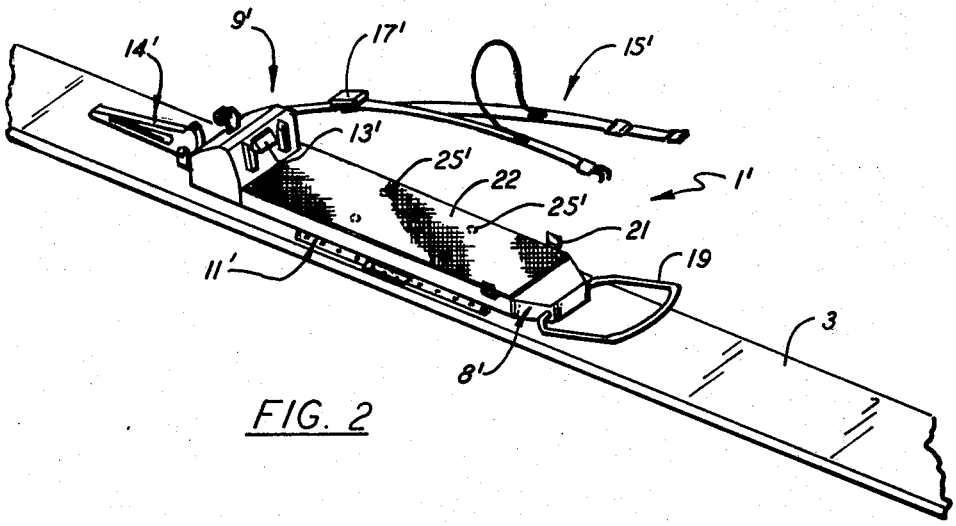
FIG. 2 is a perspective view of an alternate embodiment of a ski binding according to the invention, also shown mounted on a ski.
Figure 3:
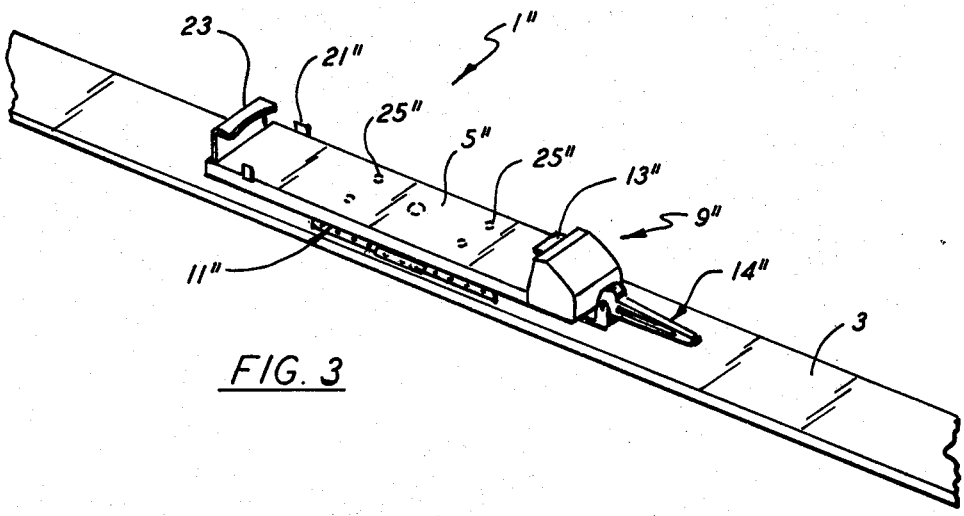
FIG. 3 shows still another embodiment of the invention in perspective, mounted on a ski.

FIG. 2 depicts a modification of the structures shown in FIG. 1, in that boot retaining member 7 has been replaced by a wire loop 19 which is mounted for pivotal movement about a forward section of a slide plate 8' of the illustrated ski binding. Loop 19 is designed to swing from a generally planar position as shown, in a counterclockwise direction over the toe portion of a ski boot seated on support member 5'. A pair of upstanding lugs 21 prevent the lateral movement of a ski boot in binding 1'. The upper surface 22 of member 5' is of honeycomb construction for removing snow, ice, or dirt from the sole of the boot to enable the boot to fit beneath latch stud 13' and loop 19 despite the presence of those materials. Ski binding 1' is in all respects, other than toe retaining member 19, and surface 22, identical to the binding shown in FIG. 1, and like parts have been ascribed like numerical designators with prime superscripts. Another modification of the ski binding shown in FIG. 1 is illustrated in FIG. 3. In the latter instance, the moveable boot engaging member is disposed forwardly of the boot support plate, and the cocking member is arranged forward of that boot engaging member.

This arrangement may in some instances prove preferable to that shown in FIGS. 1 and 2 because for many skiers the forward dispostion of lever 14 will prove more accessable and more easily rotatable than when rearwardly disposed. The ski binding in FIG. 3 is similar in most respects to those shown in FIGS. 1 and 2 (other than the reversal of the fixed and moveable toe and heel engaging members), and like parts have been ascribed like numerical designators with a double prime (") designation. The heel engaging member is an inverted L-shaped member 23 constructed to engage the rearward edge and the upper portion of the heel of a ski boot resting on support plate 5".

The ski bindings shown in FIGS. 1–3 function in substantially the same manner. Assuming that any one of the bindings is in a released condition, lever 14 is manually or otherwise rotated in the direction of the support plate 5. This action has the effect of cocking boot engaging member 9, 9', or 9". A ski boot is then placed on support plate 5 at the fixed retaining member (toe retaining member 1, loop 19, or heel piece 23), and the other end of the boot is urged downwardly against latching stud 13, 13', or 13". The latter action forces the boot engaging member 9, 9', or 9" away from support plate 5 until the upper portion of the heel or sole of the boot passes the base of latching stud 13, 13' or 13", after which the latter is driven toward the boot to retain the boot in place. Also, any safety strap associated with the ski binding would be connected to the skier's leg or ankle.

It is contemplated that the release of ski binding 1, 1' or 1" be controlled through the operation of an electronic release system which responds to forces applied to the ski boot. For this purpose, a plurality of sensors 25, 25' or 25" are provided embedded in the appropriate boot support plate for receiving such forces and for transmitting appropriate electrical signals to the balance of the electrical system. (Although the sensors are referred to as force responsive, some are in effect torque responsive although it is forces to which they respond). In the event that forces of a type predetermined to cause possible injury to the skier occur, the electrical system is actuated to effect the release of the ski binding. In such event, the linearly moveable ski binding member 9, 9', or 9" is driven in its linear path away from the boot engaging condition, to enable the ski boot to move out of binding 1, 1' or 1" to separate the ski boot from the ski.

Figure 4:
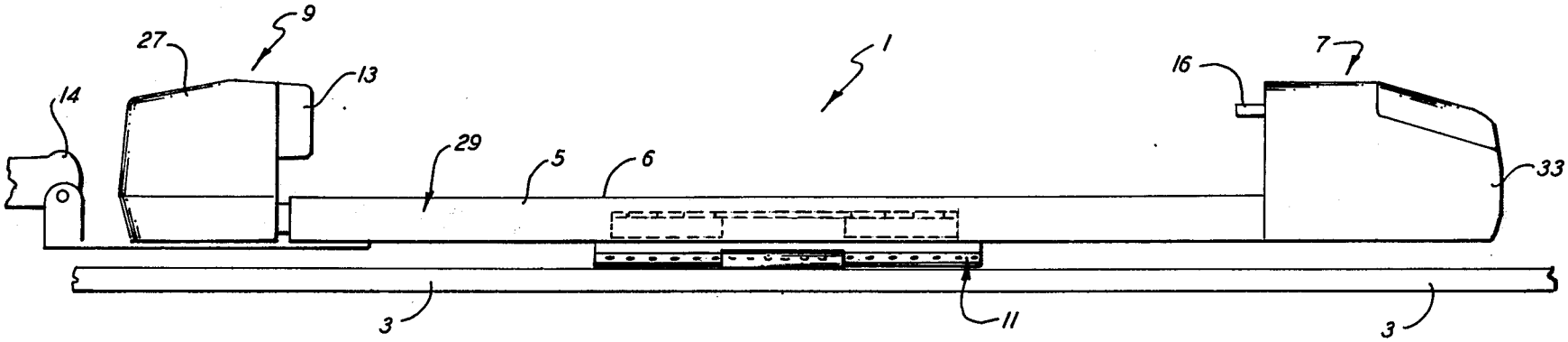
FIGS. 4 and 5 are side and top views of the apparatus shown in FIG. 1.
Figure 5:
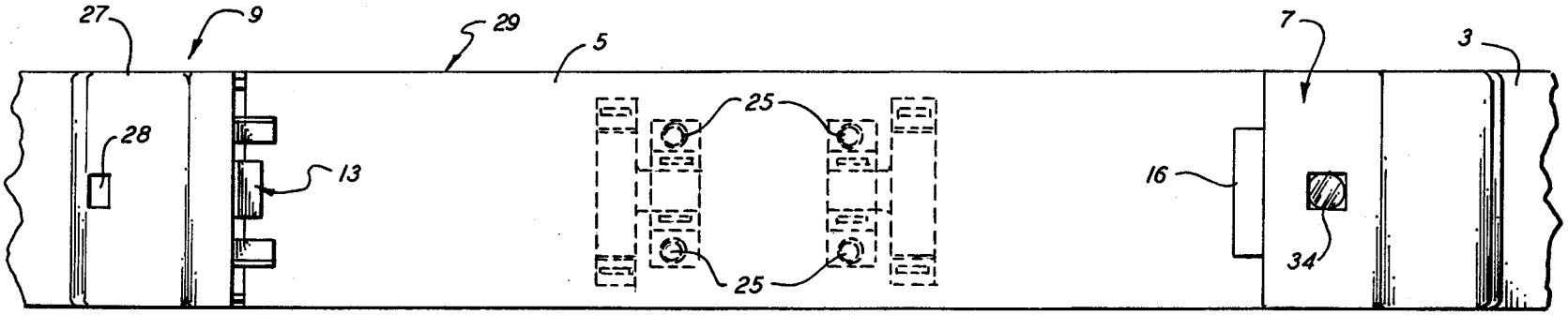

Referring next to FIGS. 4 and 5, ski binding 1 is illustrated in further detail from side and top views. (For purposes of convenience, the apparatus shown in FIGS. 4–7 is described with reference to binding 1 as shown in FIG. 1, but the description is quite applicable to the embodiments shown in FIGS. 2 and 3). Boot retaining member 9 comprises a housing 27 which, as explained below, contains a number of compression springs and related members for effecting the movement of member 9 with attached latch stud 13. Structure 28 on the top of housing 27 is provided for attaching the safety strap to the housing. It is significant that housing 27 is fully enclosed, thus protecting any components disposed therein from deleterious foreign materials such as snow, ice, and dirt. Another portion of the mechanism for operating boot engaging member 9 is disposed in a support plate housing 29 whose upper portion comprises support plate 5. Support plate assembly 29 is also environmentally secure, thus preventing deleterious matter of the type described above from entering the assembly and affecting the performance of the apparatus therein. Boot engaging member 9 is linearly moveable relative to assembly 29 in the rearward or left direction as viewed in the drawings.

Toe retaining member 7 comprises the second latch stud 16, similar to the rearwardly disposed latch stud 13, and is fixed in toe retaining member 7 by shear pins as described hereinafter. Latch 16 engages the upper surface of the forward portion of a ski boot sole, to retain the toe of the boot in the binding. Member 7 further comprises a housing 33 for containing and protecting components of the electrical system referred to above. A battery condition indicator 34 is located in the top of housing 33 for visually or audibly transmitting a signal in the event the power source for the electrical system is insufficient to adequately energize the system.

Figure 6:
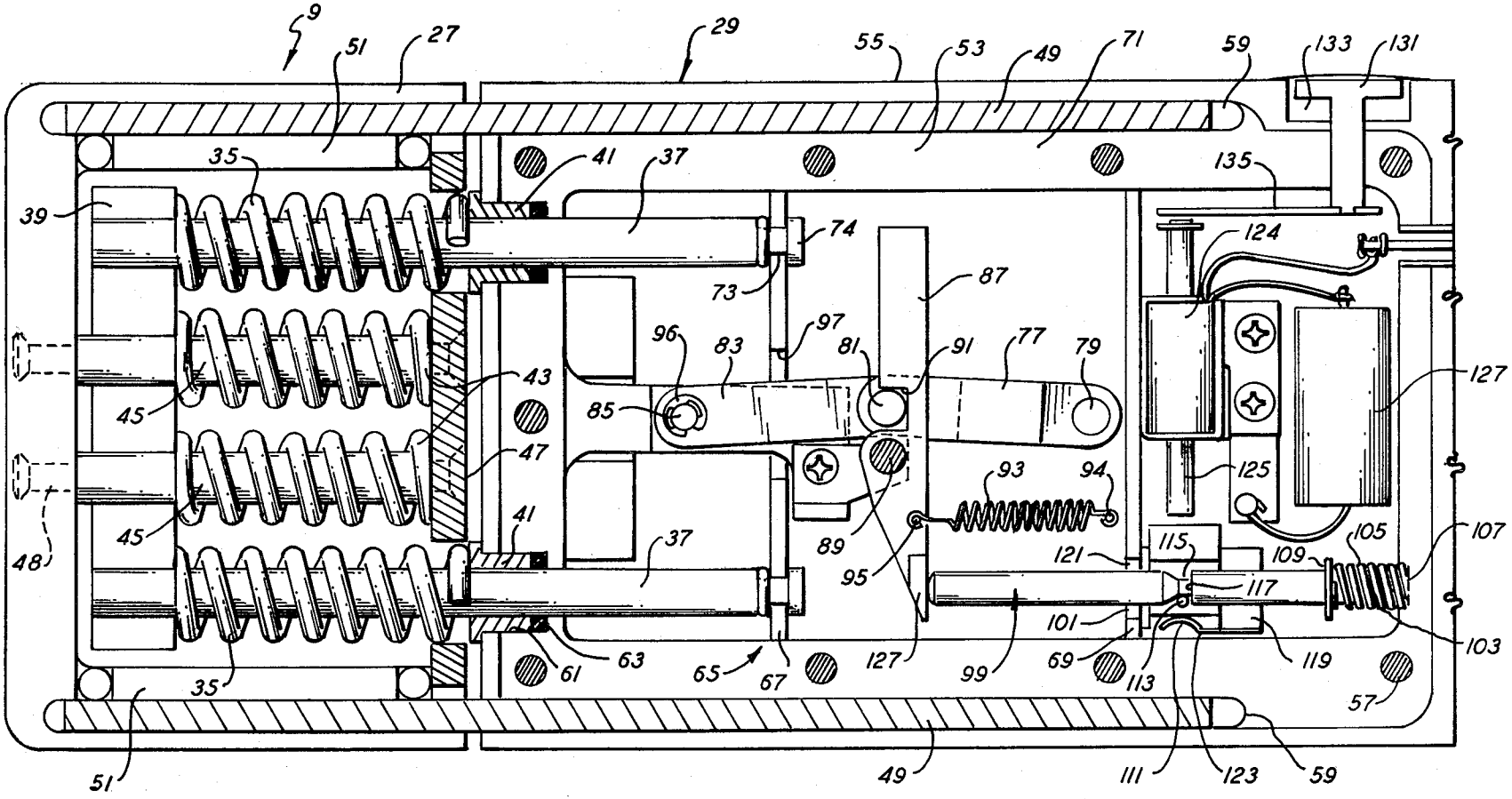
FIGS. 6 and 7 are top views of the interior components of a ski binding according to the invention, shown in cocked and released conditions, respectively.
Figure 7:
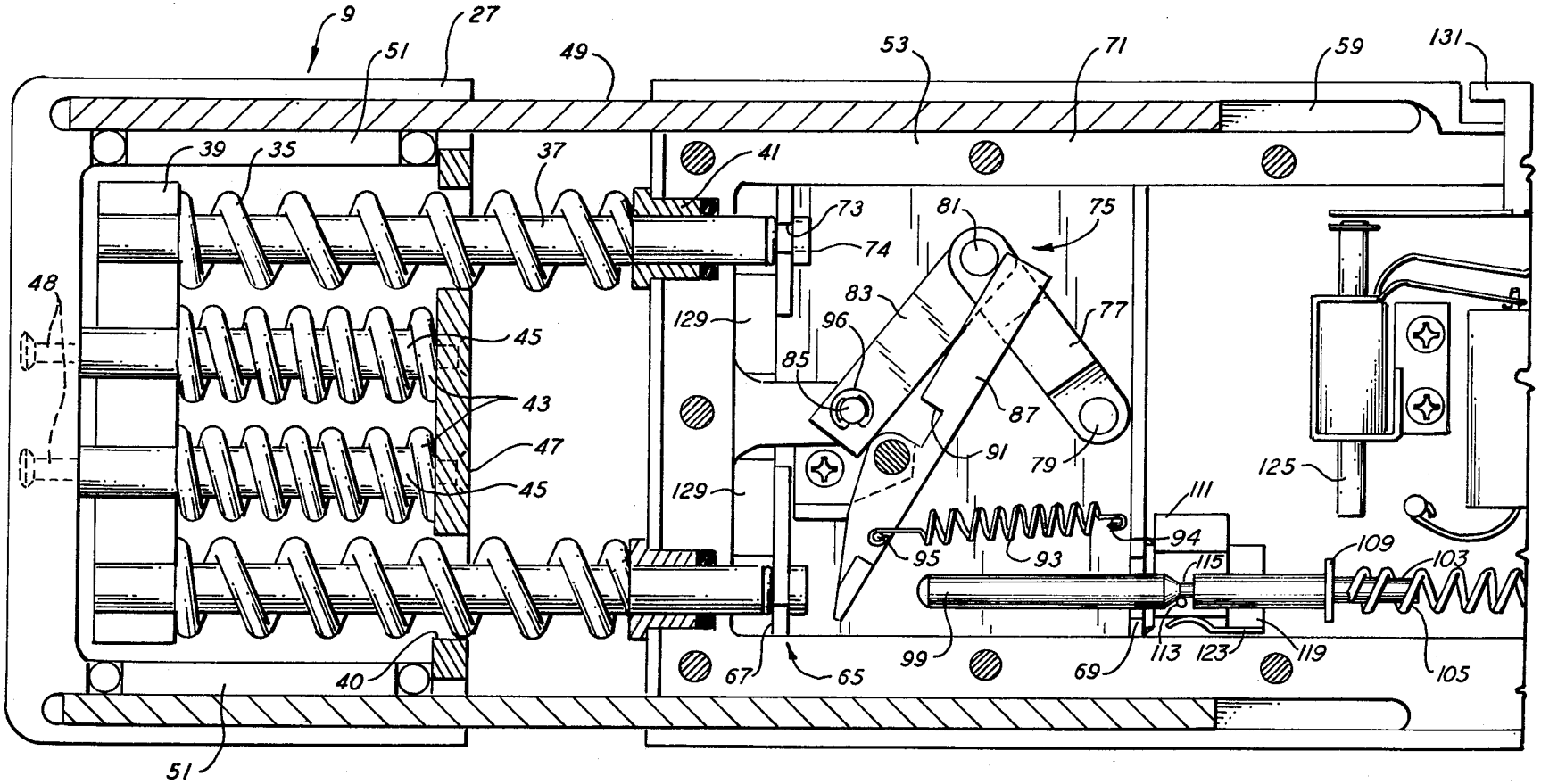

Referring now to the mechanism for cocking and releasing the boot engaging means of the present embodiment of the invention, FIG. 6 and FIG. 7 show the mechanism in its cocked and released conditions, respectively. Boot engaging member 9 includes a pair of strong compression springs 35 through which extend a pair of cylindrical guide rods 37. Springs 35 are confined between a spring retaining plate 39 and a pair of bushings 41. The rearward ends of rods 37 are secured in spring support plate 39. Springs 35 provide the energy for driving boot engaging member 9 from its first or boot engaging position shown in FIG. 6, to its second or releasing position shown in FIG. 7. A second pair of coil compression springs 43 are enclosed in housing 27 of member 9, these springs being wound about a pair of latch bars 45. Bars 45 are fixed in housing 27 by means of screws 47 at the forward end of member 9, and screws 48 at the rearward end of member 9. Springs 43 provide the energy for driving boot engaging member 9 in the forward direction. A pair of guide rails 49 extend from boot engaging member 9 and cooperate with other structure in ski binding 1 for cooperating with guide rods 37 in restraining member 9 to a linear path of movement. A pair of guide retainers 51 retain guide rails 49 in their proper location.

Support assembly 29 includes an interior support frame 53 in which various components of the mechanism are disposed. Support frame 53 is centrally disposed in assembly 29 and defines a pair of parallel channels 59 through which guide rails 49 slide as boot engaging member 9 moves in its linear path. A pair of bushing recesses 61 are located in the rearward end of assembly 29, and contain O-rings 63 to prevent moisture from entering the interior of assembly 29. The function of bushing 41 is to retain guide rods 37 in a linear path of movement and to further prevent deleterious matter from entering assembly 29.

A toggle frame 65 is located in support frame 53. Toggle frame 65 is a channel-shaped member having upstanding ends 67 and 69. Support frame 53 includes a pair of parallel upstanding walls 71 which restrain toggle frame 65 in place for linear movement in conjunction with the other linearly movable members described herein. The rearward upstanding wall 67 of toggle frame 65 has a pair of holes 73 for receiving reduced portions of guide rods 37. Guide rods 37 terminate in expanded, head portions 74, and the portions of guide rods 37 on opposite sides of wall 67 fix the guide rods to that wall.

A toggle assembly 75 is further contained in support frame 53. Toggle assembly 75 includes a first toggle arm 77 mounted for rotation about a first pivot pin 79 fixed to toggle frame 65, and a second pivot pin 81 which is mounted on the end portion of a second toggle arm 83. Toggle arm 83 is pivotally mounted on a second pivot pin 85 fixed to support frame 53. Toggle assembly 75 further includes a toggle latch 87 which is mounted on a pivot pin 89 fixed to frame 65. Toggle latch 87 includes a notch 91 dimensioned to receive and retain pivot pin 81. A coil spring 93, fixed between a mounting pin 94 extending from toggle frame 65, and a second pin 95 on toggle latch 87, biasses the toggle latch in a counter-clockwise direction. A retaining ring 96 maintains toggle arm 83 on pivot pin 85. An opening 97 is provided in wall 67 of toggle frame 65 for enabling toggel arm 83 to swing through a restricted arc as described hereinafter.

Toggle latch 87 is disposed in the path of movement of a firing pin 99 extending through an opening 101 in the forward wall 69 of toggle assembly 65. Firing pin 99 has a spring support rod 103 which extends into a coil spring 105. Spring 105 is confined between the forward wall of a recess 107 of support frame 53 and a collar 109 on firing pin 99. Spring 105 biases firing pin 99 in the rearward or left direction as viewed in the drawing.

A firing pin latch 111 is mounted for movement in a path perpendicular to the path of movement of firing pin 99 in support frame 53. Latch 111 carries an upstanding retaining pin 113 constructed to enter a reduced portion 115 in firing pin 99 and for abutting against a flat shoulder 117 defining the forward end of that portion. The path of movement of latch 111 is controlled by a guide block 119 (which is rigidly attached to the forward wall 69 of toggle assembly 65). Bushing 121 is disposed in opening 101 for further maintaining firing pin 99 in its proper path. A leaf spring 123 biasses latch 111 upwardly as viewed in the drawing to urge pin 113 into reduced portion 115 and to prevent inadvertent release due to vibrations of the mechanism. When pin 113 is disposed in portion 115, it retains firing pin 99 in a cocked position wherein spring 105 is compressed and biases firing pin 99 in a rearward or left direction.

The movement of latch 111 is effected by a solenoid 124 which forms a component of an electric release system comprising a capacitor 126, transducers 25, and other components forming an electrical circuit. When solenoid 124 is energized, a solenoid arm 125 is driven against latch 111 to move retaining pin 113 out of recessed portion 115. Such energization occurs in response to electrical signals generated by the electronic release system in accordance with the sensing of forces which exceed a predetermined threshold value. Solenoid arm 125 is biased to its inactive position as indicated in FIG. 6 wherein it is disengaged from latch 111, and only moves against the latch in response to such signal, after which it returns to its inactive position.

FIG. 7 shows the mechanism in its second or releasing condition. Toggle assembly 75 is in a folded condition, and the assembly must be moved to an unfolded condition wherein toggle arms 77 and 83 are in a generally linear relationship and perpendicular to toggle latch 87 to cock the mechanism as shown in FIG. 6. The cocking of the mechanism further requires that springs 35 be compressed as shown in FIG. 6. In order to cock the mechanism, boot engaging member 9 must be moved forwardly or to the right as shown in FIGS. 6 and 7 by some appropriate means such as manually, or with the assistance of lever 14 as discussed elsewhere. The forward movement of member 9 moves housing 27 forwardly relative to springs 35, and the latter are compressed along guide rods 37. The forward movement of boot engaging member 9 further effects the forward movement of guide rods 37, toggle frame 69, and guide rails 49, as well as other components connected to the foregoing. The forward movement of boot engaging member 9 terminates when housing 27 contacts support plate housing 29 and pivot pin 81 is secured in notch 91 of rocker arm 87.

Thus, as member 9 moves forwardly, it in effect pushes toggle frame 65 forwardly, and carries pivot pin 79 in the same direction. The forward movement of pin 79 relative to fixed pin 85 effects the counter-clockwise rotation of toggle arm 77 about pin 79 and a clockwise rotation of toggle arm 83 about pin 85. Thus, toggle assembly 75 unfolds during the cocking operation, and pin 81 moves in the direction of notch 91 during this process. At the conclusion of the cocking operation, rails 49 approach the forward ends of channels 59, toggle arms 77 and 83 assume a generally linear relationship (although slightly buckled in an upward direction as viewed in the drawings), and pivot pin 81 is disposed in notch 91. Also, firing pin 99 is moved forwardly by pin 113 pressing against shoulder 117 to compress coil spring 103. Toggle frame 65 has carried spring pin 94 in the forward direction, and spring 93 has rotated toggle latch 87 in a counter-clockwise direction so that it extends in a generally perpendicular direction transverse to the ski. The cocking operation places the mechanism in the condition shown in FIG. 6.

When a skier is properly mounted on ski 3, the ski boot is secured between boot engaging member 9 and toe engaging member 7, and the release mechanism is in the condition shown in FIG. 6. As the skier proceeds in a run down a ski slope, various electrical signals are generated in response to forces and torques applied to transducers 25. When an electrical signal is generated indicating that the release of the ski boot from the ski binding should occur, the electrical system energizes solenoid 124, and solenoid arm 125 is electromagnetically driven against latch member 111, to drive retaining pin 113 out of engagement with shoulder 117. The latter action frees firing pin 99 to the influence of coil spring 105, which drives firing pin 99 rearward (or leftward) into engagement with a paddle portion 127 of toggle latch 87. This paddle portion is an abutment surface extending from the plane of the drawing and being disposed in the path of movement of firing pin 99. As firing pin 99 moves rearwardly, it rotates toggle latch 87 in a clockwise direction against the bias of spring 93 until pin 81 is freed from notch 91 in the toggle latch since spring 103 is stronger than spring 93. Pin 113 rides on the forward cylindrical part of firing pin 99 for a brief period following the initial movement of the firing pin. Since the engagement of pin 81 with the walls defining notch 91 was the only means restraining toggle frame 65 in place against the force of springs 35, the removal of pin 81 from notch 91 releases compression springs 35 from their confinement. Springs 35 expand rearwardly from bushings 41 against which they are seated, against spring support plate 39 to drive boot engaging member 9 rearwardly, carrying guide rods 37 and toggle frame 65 rearwardly as well. As toggle frame 65 moves rearwardly, toggle assembly 75 folds as pin 79 mounted on toggle frame 65 approaches fixed toggle pin 85. Guide rails 49 also move rearwardly in their channels 59 to retain boot engaging member 9 in its linear part of movement. As latch 87 approaches its fully folded condition the forward force of spring 93 exerted on firing pin 99 via paddle 127 exceeds the opposing force of spring 105, and eventually paddle 127 moves firing pin 99 forwardly until pin 113 drops into recess 115 to secure firing pin 99 to frame 65, where pin 113 remains for the duration of the release. The linear, rearward movement of boot engaging member 9 terminates when toggle frame 65 abuts against blocking structure 129 in support frame 53 and springs 35 are substantially extended. At this time, the apparatus has returned to the condition depicted in FIG. 7. Therefore, stud 13 is disengaged from the structure associated with the ski boot which it had retained in the ski binding, and the boot is free to slip out of the ski binding.

There are many situations wherein a skier would desire to release a ski boot from the ski binding in the absence of forces on the ski boot sufficient to effect release. In fact, in the normal situation, a skier will complete a ski run without a safety release, and will need to release the boot from the binding. Therefore, a manual release apparatus is provided in the mechanism depicted in the drawings. Referring still to FIGS. 6 and 7, a manually actuable button 131 is shown extending from the interior of binding 1 to its outer surface rendering it easily accessible to a skier mounted on the skis. Release button 131 has an expanded head portion which is substantially flush with the exterior surface of the binding, and rests on a gasket 133. The configuration of button 131 and of gasket 133 prevent foreign material from entering the interior of the mechanism in the vicinity of the release button. The inner portion of manual release button 131 is secured to a manual release leaf 135. Leaf 135 is a member fixed relative to button 131 and movable with button 131 against solenoid arm 125 of solenoid 124. Upon the depression of manual release button 131, leaf 135 drives solenoid arm 125 against latch 111 to move retaining pin 113 out of engagement with shoulder 117 of recess 115 in firing pin 99, when the release mechanism is in the cocked condition (FIG. 6), whereby release occurs as described previously. Alternatively, a switch could be provided for selectively energizing solenoid 124 to release the binding in the absence of high or prolonged forces or torques.

Figures 8, 9, 10:
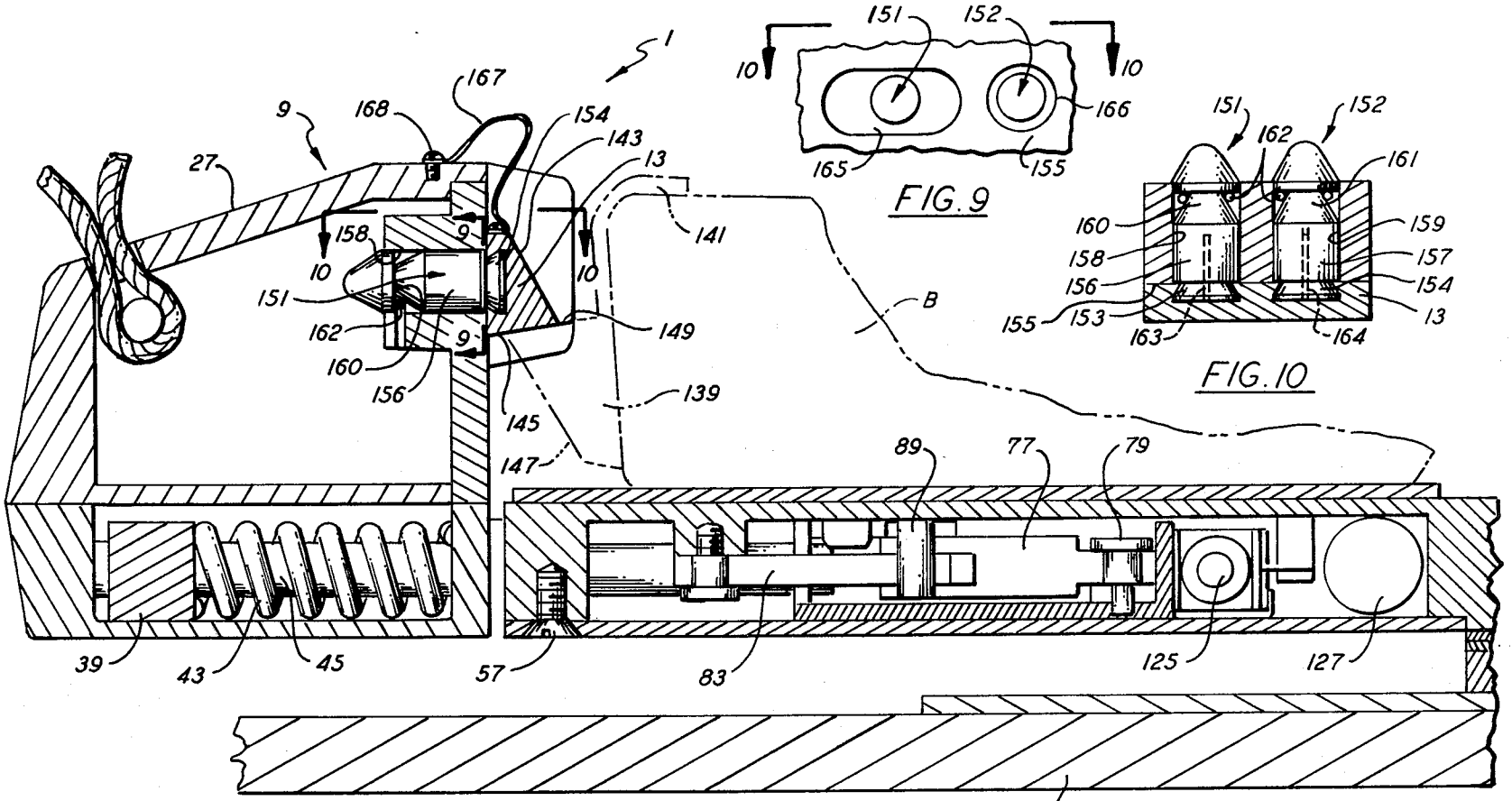
FIG. 8 is a side, detailed, cut-away view of a latching mechanism incorporated in the apparatus shown in the previous figures.
FIG. 9 is a detailed, partial view taken in the direction 9—9 indicated in FIG. 8.
FIG. 10 is a partial, top view taken in the direction 10—10 shown in FIG. 8.

The ski binding shown in FIG. 1 includes step-in feature mentioned previously. FIG. 8 shows latch stud 13 in engagement with structure associated with ski boot B disposed in binding 1. The latter structure (which can be an integral part of the boot) includes a boot stud 139 attached to a support plate 141 which is in turn secured to the heel of ski boot B. Latch 13 includes a first cam surface 143 which is downwardly and forwardly inclined, and a lower abutment surface 145 which is upwardly and forwardly inclined, the latter surfaces meeting at a juncture. Similarly, boot stud 139 includes a lower, forwardly and downwardly inclined cam surface 147 configured to slide over cam surface 143, and an upper, rearwardly and downwardly inclined abutment surface 149 configured to engage surface 145 of latch stud 13 to retain the ski boot in the ski binding.

Springs 43 (FIGS. 6, 7 and 8) functions to bias heel retaining member 9 in the forward direction. When a ski boot is inserted into ski binding 1, the toe of the boot is appropriately positioned and the heel is lowered into the rearward part of the ski binding. As cam surface 147 of boot stud 139 slides down cam surface 143 of latch stud 13, the force of the boot drives heel engaging member 9 rearwardly against the bias of springs 43. When cam surface 147 clears cam surface 143, boot stud 139 slips beneath latch stud 13, and springs 43 return heel retaining member 9 to the forward position. Latch stud 13 slides over boot stud 139 with surfaces 145 and 149 in engagement. Until heel retaining member 9 is driven rearwardly by springs 35, either because of the effects of sensed forces on the system or because of the depression of manual release button 131, boot B remains secured in the ski binding.

Latch stud 13 is fixed in boot engaging member 9 by a pair of shear pins 151, 152 (FIGS. 8–10). Shear pins 151, 152 are provided for disabling latch stud 13 from its shear engaging function in the event that the binding release mechanism or the controlling electrical system for some reason malfunction, and release does not occur despite the application of dangerously high forces or torques to the ski boot. Shear pins 151, 152 have expanded end portions 153, 154 which are keyed in correspondingly configured recesses in latch stud 13, and fix stud 13 in place against a forward wall 155 of boot retaining member 9. The rearwardly located body portions 156, 157 of pins 153, 154 are generally torpedo shaped, having cylindrical sections received in sliding engagement in cylindrical slots 158, 159 in wall 155. Neck portions 160, 161 are defined in the rearward parts of pins 151, 152 and are each engageable by a locking pin 162 for maintaining the respective positions of the shear pins. Locking pin 162 can be a generally U-shaped member fixed at its opposite ends in member 9 and configured to slide under the neck portions of the shear pins.

Forward, expanded portions 153, 154 of shear pins 151, 152 are attached to body portions 156, 157 by means of frangible pins 163, 164 which extend through portions 153, 154 into portions 156, 157 (FIG. 10). The frangible pins are severable by the surfaces defining oblong slot 165 and circular slot 166 shown in FIG. 9.

Shear pins 151, 152 provide for the severance of latch stud 13 in the event that the release system fails to release a retained boot upon the occurrence of dangerously high forces or torques. In nearly all situations, the forces associated with torquecaused injuries are of a lower magnitude than vertical forces associated with impact-caused injuries. Therefore, shear pins 151, 152 are arranged in slots 165, 166 so that pins 163, 164 separately absorb torque forces but collectively absorb vertical forces.

When there has been a malfunction of the main mechanical or electrical system, and potentially injurious torques or sidewise forces are applied to the retained ski boot, boot stud 139 transmits these torques to latch stud 13, and shear forces are exerted on pin 164 by the edge of slot 166 at the juncture of stud 13 and wall 155. If the shear forces are of sufficient magnitude, frangible pin 164 is severed; and if the torque of sidewise force persists, a similar shearing action by an end surface of slot 165 is subsequently applied to pin 163 to sever the latter and detach latch stud 13 from its position against wall 155 of heel retaining member 9.

In the event of the malfunctioning of the main system, and the application of high vertically acting forces to the ski boot, such forces are also transmitted to latch stud 13. In this situation, shear forces are applied by the upper or lower edges of slots 165 and 166 simultaneously to both pins 163, 164 at the juncture of latch stud 13 and wall 155, and if the shear force is sufficient, both pins 163, 164 sever to detach latch stud 13 from its mounting on wall 155.

A small cord or wire 167 connects latch stud 13 to a screw or other member 168 attached to housing 27 of member 9. If shear pins 160, 161 are severed as explained above, latch stud 13 remains connected to the ski binding. The skier can replace the severed shear pins 160, 161 in the recesses in latch stud 13, and insert the shear pins into slots 158, 159 in wall 155. The latter action simply forces the body portions of the severed shear pins over locking pin 162 into the inner compartment of housing 27, and the new shear pins slide over locking pin 162 to re-secure latch stud 13 to heel retaining member 9.

Toe latch stud 16 is mounted on toe retaining member 7 in the same manner as latch stud 13 is mounted on heel retaining member 9. The details of this mounting are therefore omitted, but reference is made to the previous discussion for an explanation of the manner in which stud 16 is mounted in place.

Figure 11:
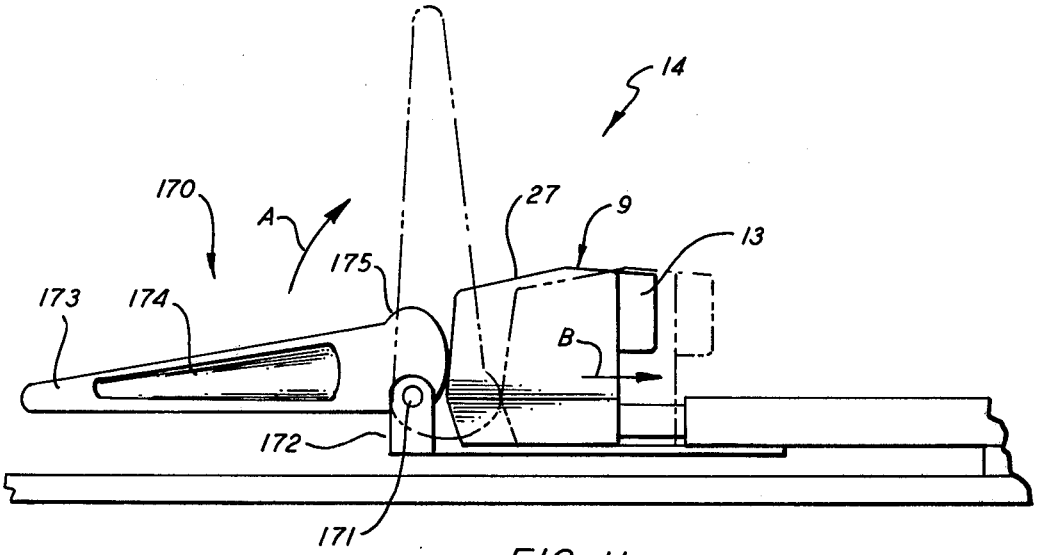
FIG. 11 is a side view of a mechanism for cocking the apparatus shown in the previous figures.

Lever assembly 14 for cocking the release mechanism of the described ski binding is shown in FIG. 11. Lever assembly 14 includes a lever 170 mounted on an axle 171 rotatably mounted in a pair of opposing support posts 172. Lever 170 includes a manually graspable arm 173 disposed on one side of axle 171 and having opposing recessed portions 174 adapted to be gripped by a skier bare-handed, or with gloves or mittens on. Lever 170 terminates on the other side of axle 171 in a cam portion 175. Lever 170 is manually rotatable from the horizontal position shown in solid lines in a clockwise direction as indicated by arrow A, to the vertical position shown in phantom. Cam portion 175 is configured relative to the configuration of housing 27 of member 9 to drive member 9 forwardly, as indicated by arrow B, the distance required to transpose the release mechanism of ski binding 1 from the condition shown in FIG. 7 to that shown in FIG. 6.

Figure 12:
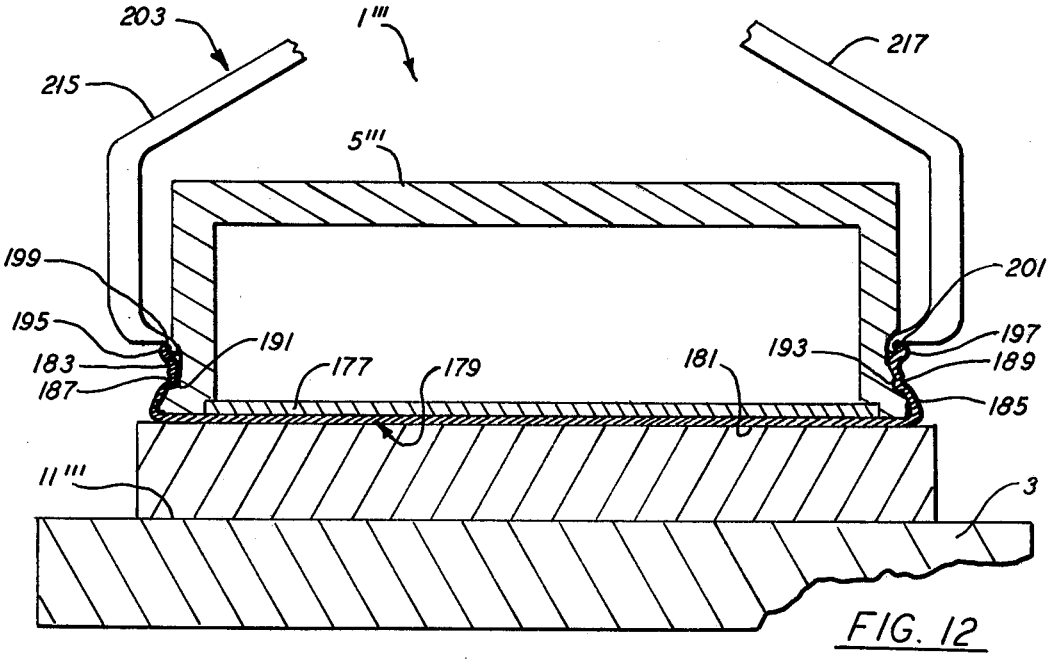
FIG. 12 is a cross-sectional view of a ski binding according to the invention showing means for adjusting the location of the binding on the ski.

In order to facilitate a skier's control over his skis, to provide him with proper balance, and to enhance the contact between the snow and the snow-engaging surfaces of the skis, it is customary to position ski bindings on skis so that the forward portion of the ski boot mounted in the binding is near the midpoint of the ski between the forward and rearward ends thereof. Many ski bindings are permanently positioned on skis by screws or the like according to the size boot to be received in the binding, so that the bindings must be unscrewed from the skis and relocated thereon if another size boot is to be used. However, it was explained earlier that ski bindings are known wherein the binding can be adjusted to receive a range of ski boot sizes. FIG. 12 shows a construction in ski binding 1 which enables the particularly easy adjustment of the ski binding to accommodate many sizes of ski boots by locating their forward portions near the middle of the ski.

FIG. 12 shows a cross section of a ski binding 1''' similar to those described previously, but the release mechanism members have been omitted for the sake of clarity. Thus, binding 1''' is seen to include boot support plate 5''' disposed on a housing cover plate 177 and within a side clamping member 179. Plates 5 and 177 are fixed together but are movable within clamping member 179 which is attached to pedestal 11''' by appropriate fastening means (not shown). Clamping member 179 includes a base portion 181 sandwiched between housing cover plate 177 and pedestal 11''', and a pair of parallel, upstanding flanges 183, 185. Flanges 183, 185 have internal grooves for cooperating with corresponding structure on member 5''' to facilitate the sliding of the latter between flanges 183, 185. Flanges 183, 185 are further provided with a plurality of inwardly extending tabs 187, 189 for entering corresponding tab sockets 191, 193 in the outer surfaces of member 5'''. The foregoing tabs and sockets are spaced along the sides of flanges 183, 185 and member 5''' respectively. The latter can be moved along the binding between the opposing flanges, and locked in place by having a pair of opposed tabs 187, 189 seat within a corresponding pair of sockets 191, 193.

Clamping member 179 is preferably a unitary resilient member fabricated from a strong, corrosion resistant material such as spring steel. Flanges 183, 185 are inwardly inclined as viewed in the drawing and form acute angles with the centrally disposed flat portion 181 between the flanges. Flanges 183, 185 are biassed towards the locking position illustrated in FIG. 12, and they must be opened or bent towards the vertical position relative to the plane of ski 3 in order to disengage tabs 187, 189 from sockets 191, 193 so that the position of plate 5''' can be adjusted on the ski. Flanges 183, 185 terminate at their upper edges in outwardly bent lips 195, 197 running along the lengths of the two flanges. Lips 195, 197 terminate in inwardly folded curled sections 199, 201.

Figure 13:
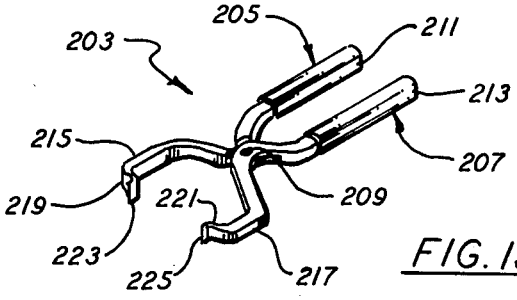
FIG. 13 is a perspective view of a tool for effecting the adjustment of the ski binding shown in FIG. 10.

In order to open or spread flanges 183, 185, a tool such as the pliers 203 in FIG. 13 can be employed. Pliers 203 include sections 205 and 207 mounted for rotation on a pivot post 209. The pliers also include handles 211, 213 which operate jaw members 215, 217. The latter members terminate at their free ends in inwardly extending sections 219, 221 whose end portions 223, 225 are outwardly extending lips configured to engage lips 199, 201 of flanges 183, 185. To spread flanges 183, 185, handles 211, 213 are adjusted to space lips 223, 225 so that they can be fitted within lips 199, 201 of the flanges. The handles are then drawn together, causing jaws 215, 217 to open; the respective lips of pliers 203 and flanges 183, 185 are hooked together so that the flanges open as handles 211, 213 are closed. Suport member 5''' can be adjusted and locked in clamping member 179, after which the plier handles are opened and flanges 183, 185 resume their locking condition with tabs 187, 189 seated in appropriate sockets 191, 193.

The embodiments of the invention described herein are highly effective and attractive ski bindings which fully accomplish the objects set forth previously. The ski bindings according to the invention are safe from deleterious foreign material because of the environmental security of the bindings. The step-in feature of the invention enables the extremely easy mounting of a ski boot in the binding. The ski bindings described herein are particularly compatible for operation in conjunction with electronic release systems. The bindings are compact, have a low profile on the ski to which they are connected, and are very aesthetic. They can be economically manufactured using conventional equipment and materials, and they are efficient and effective in use.

The invention has been described in detail with particular reference to preferred embodiments thereof, but variations and modification within the spirit and scope of the invention may occur to those skilled in the art to which the invention pertains.

We claim:

1. A ski binding for releasably securing a ski boot to a ski and for releasing the ski boot upon the application of predetermined forces to the ski boot, said ski binding comprising:

boot engaging means for engaging structure associated with a ski boot disposed in the ski binding for securing the ski boot to the ski, said boot engaging means being movable between a first position for securing the ski boot to the ski and a second position for releasing the ski boot from the ski; and said boot engaging means comprising: first biassing means for urging said boot engaging means towards said first position, said boot engaging means being movable from said first position towards second position in response to the insertion of a ski boot into the ski binding and the pressing of the ski boot against said boot engaging means, and said first biassing means moving said boot engaging means back to the first position upon the completion of the insertion of the ski boot into the ski binding;

guide means for guiding said boot engaging means in a linear path on the ski between the first position and the second position;

second biassing means for urging said boot engaging means towards said second position;

latching means having a latching condition for retaining said boot engaging means in said first position against the bias of said second biassing means, and an unlatching condition for releasing said boot engaging means to the bias of said second biassing means; and unlatching means for placing said latching means in the unlatching condition in response to the application of said predetermined forces to the ski boot.

2. The invention according to claim 1 wherein said boot engaging means further comprises cam means engageable by the structure associated with the ski boot during the insertion of the ski boot into the ski binding for translating forces exerted by the ski boot into pressure for moving said boot engaging means towards said second position.

3. The invention according to claim 2 wherein said boot engaging means comprises movable carriage means for carrying said cam means, and housing means for housing apparatus within said carriage means; and said first biassing means is disposed in said housing means.

4. The invention according to claim 1 wherein:

said boot engaging means comprises movable carriage means carrying a surface configured to engage the structure associated with the ski boot when said carriage means is in said first position; and said second biassing means comprises spring means operatively associated with said boot engaging means and energizable for applying force against said carriage means to place said carriage means in a cocked condition wherein said carriage means is in said first position and is biassed towards said second position; and said latching means comprises toggle means having a locking condition for retaining said carriage means in said cocked condition against the force of said spring means, and an unlocking condition for releasing said carriage means to the force of said spring means to drive said carriage means from said first position to said second portion; and said unlatching means comprises actuating means for transferring said toggle means from the locking condition to the unlocking condition in response to the application of said predetermined force to the ski boot.

5. The invention according to claim 4 wherein:

said toggle means comprises abutment means movable from a set position to a releasing position for placing said toggle means in said unlocking condition; and said unlatching means comprises firing means movable from a cocked position to a firing position in engagement with said abutment means for moving said abutment means to said releasing position, third biassing means for urging said firing means from the cocked position to the firing position, second latching means for retaining said firing means in said cocked position against the influence of said third biassing means, and second unlatching means for disabling said second latching means in response to the application of said predetermined forces to the ski boot.

6. The invention according to claim 5 wherein said second unlatching means comprises solenoid means actuable in response to said predetermined forces for disabling said second latching means.

7. The invention according to claim 1 wherein said boot engaging means comprises a movable housing, and at least a portion of said second biassing means is disposed in said movable housing.

8. The invention according to claim 1 wherein:

said boot engaging means comprises movable carriage means for carrying a boot engaging surface engageable with structure associated with a ski boot for retaining the ski boot in the ski binding when said carriage means is in said first position, and housing means for housing apparatus within said carriage means; and said second biassing means comprises compression spring means compressible into said housing means for cocking said boot engaging means when said boot engaging means is in said first position.

9. The invention according to claim 8 and further including:

cocking means for moving said boot engaging means from said second position to said first position and for compressing said compression spring means into said housing, said cocking means comprising cam means moveable over a predetermined path in engagement with said boot engaging means for moving said boot engaging means from said second position to said first position, and lever means connected to said cam means for moving said cam means over said predetermined path.

10. The invention according to claim 8 and further including:

latch carriage means for carrying at least a portion of said latching means, said latch carriage means being connected to said boot engaging carriage means and mounted for linear movement on the ski in conjunction with the movement of said boot engaging carriage means between said first and second positions.

11. The invention according to claim 1 wherein said unlatching means comprises electric solenoid means actuable for placing said latching means in said unlatching condition.

12. The invention according to claim 1 and further including:

alternate unlatching means, said alternate unlatching means comprising manually operable means for selectively placing said latching means in the unlatching condition in response to the selective application of a force less than said predetermined forces to said alternate unlatching means.

13. The invention according to claim 1 wherein:

said unlatching means comprises an electrical system having an electrical battery for energizing the system; and said ski binding further comprises safety strap means for attaching the ski to a skier using the ski even after the release of the ski boot from the ski binding, and said safety strap means further includes holding means for holding said electrical battery.

14. The invention according to claim 1 wherein:

said boot engaging means comprises a boot engaging member movable between said first and second positions rearward of a ski boot in the ski binding, said boot engaging member being engageable with structure associated with the heel of a ski boot in the ski binding when said boot engaging member is in said first position; and said ski binding further includes toe engaging means disposed forward of said boot engaging member for retaining the ski boot toe in the ski binding when said boot engaging member is in said first position.

15. The invention according to claim 14 wherein said toe engaging means comprises a loop for receiving the toe portion of a ski boot.

16. The invention according to claim 1 and further including base plate means for supporting a ski boot in the ski binding and mounting means for mounting said base plate means on the ski, said mounting means comprising:

a pair of opposing, resilient clamping members disposed on opposite sides of the ski, and biased to a gripping position to grip opposite sides of structure associated with said base plate means to retain said base plate means at a predetermined position on the ski, said clamping members being separable from said gripping position to release said base plate means for displacement in said mounting means.

17. The invention according to claim 1 wherein said boot engaging means comprises support structure mounted on the ski, stud means for engaging the structure associated with the ski boot to retain the ski boot in the ski binding when said boot engaging means is in said first position, shear pin means for attaching said stud means to said support structure, and shearing means for shearing said shear pin means to detach said stud means from said support structure in response to the application of predetermined forces to the ski boot.

18. The invention according to claim 17 wherein said shear pin means comprises first and second shear pin means; and said shearing means includes first shearing means for shearing said first and second shear pin means simultaneously in response to the application of predetermined forces to the ski boot in a first direction, and second shearing means for shearing said first and second shear pin means in sequence in response to the application of predetermined forces to the ski boot in a second direction resulting from predetermined torques to the ski boot.

19. The invention according to claim 1 wherein said ski binding includes structure for overlapping a portion of a ski boot disposed in the ski binding; and compressible boot supporting means having a boot engaging surface, a relaxed condition wherein said boot engaging surface is disposed close to said overlapping structure and a compressed condition wherein said boot engaging surface is disposed further from said overlapping structure; said boot supporting means being placed in the compressed condition when pressure from a ski boot is applied to said boot engaging surface to enable the portion of the ski boot to fit beneath said overlapping structure despite the presence of foreign matter on the bottom of the ski boot.

20. The invention according to claim 1 wherein said ski binding comprises boot supporting means for engaging the bottom of a ski boot disposed in the ski binding, said boot supporting means including a honeycomb structure having surfaces for removing foreign matter stuck to the bottom of the ski boot.

21. A ski binding for securing a ski boot to a ski and for releasing the ski boot upon the application to the ski boot of any of a plurality of different predetermined forces in predetermined directions corresponding to the respective predetermined forces, said ski binding comprising:

support structure mounted on the ski;

stud means for engaging a ski boot disposed in the ski binding to retain the ski boot in the binding; and shear pin means for attaching said stud means to said support structure, said shear pin means severing in response to the application to the ski boot of one of said predetermined forces in its corresponding predetermined direction to detach said stud means from said support structure.

22. The invention according to claim 21 wherein said shear pin means comprises first and second shear pin means; and said support structure includes first shearing means for severing said first and second shear pin means simultaneously in response to the application of predetermined forces to the ski boot in a first direction and second shearing means for severing said first and second shear pin means in sequence in response to the application of predetermined forces to the ski boot in a second direction resulting from predetermined torques applied to the ski boot.

23. A ski binding for releasably securing a ski boot to a ski and for releasing the ski boot upon the application of predetermined forces to the ski boot, said ski binding comprising:

boot engaging means for engaging structure associated with a ski boot disposed in the ski binding for securing the ski boot to the ski; said boot engaging means comprising a movable housing;

guide means for guiding said boot engaging means in a linear path on the ski between a first position where said boot engaging means secures the ski boot to the ski and a second position spaced from the ski boot wherein the boot engaging means does not secure the ski boot to the ski;

biassing means for urging said boot engaging means towards said second position; at least a portion of said biassing means being disposed in said movable housing;

latching means having a latching condition for retaining said boot engaging means in said first position against the bias of said biassing means, and an unlatching condition for releasing said boot engaging means to the bias of said biassing means; and unlatching means for placing said latching means in the unlatching condition in response to the application of said predetermined forces to the ski boot.

24. The invention according to claim 23 wherein said boot engaging means comprises:

spring biassing means for urging said boot engaging means towards said first position, said boot engaging means being movable from said first position towards said second position in response to the insertion of a ski boot into the ski binding and the pressing of the ski boot against said boot engaging means, and said spring biassing means moving said boot engaging means back to said first position in response to the cessation of the pressing of the ski boot against said boot engaging means.

25. The invention according to claim 23 wherein said unlatching means comprises electric solenoid means actuable for placing said latching means in said unlatching condition.

26. The invention according to claim 23 and further including:

alternate unlatching means, said alternate unlatching means comprising manually operable means for selectively placing said latching means in the unlatching condition in response to the selective application of a force less than said predetermined forces to said alternate unlatching means.

27. The invention according to claim 23 wherein:

said unlatching means comprises an electrical system having an electrical battery for energizing the system; and said ski binding further comprises safety strap means for attaching the ski to a skier using the ski even after the release of the ski boot from the ski binding, and said safety strap means further includes holding means for holding said electrical battery.

28. The invention according to claim 23 wherein:

said boot engaging means comprises a boot engaging member movable between said first and second positions rearward of a ski boot in the ski binding, said boot engaging member being engageable with structure associated with the heel of a ski boot in the ski binding when said boot engaging member is in said first position; and said ski binding further includes toe engaging means disposed forward of said boot engaging member for retaining the ski boot toe in the ski binding when said boot engaging member is in said first position.

29. The invention according to claim 28 wherein said toe engaging means comprises a loop for receiving the toe portion of a ski boot.

30. The invention according to claim 23 and further including base plate means for supporting a ski boot in the ski binding and mounting means for mounting said base plate means on the ski, said mounting means comprising:

a pair of opposing, resilient clamping members disposed on opposite sides of the ski, and biased to a gripping position to grip opposite sides of structure associated with said base plate means to retain said base plate means at a predetermined position on the ski, said clamping members being separable from said gripping position to release said base plate means for displacement in said mounting means.

31. The invention according to claim 23 wherein said boot engaging means comprises support structure mounted on the ski, stud means for engaging the structure associated with the ski boot to retain the ski boot in the ski binding when said boot engaging means is in said first position, shear pin means for attaching said stud means to said support structure, and shearing means for shearing said shear pin means to detach said stud means from said support structure in response to the application of predetermined forces to the ski boot.

32. The invention according to claim 31 wherein said shear pin means comprises first and second shear pin means; and said shearing means includes first shearing means for shearing said first and second shear pin means simultaneously in response to the application of predetermined forces to the ski boot in a first direction, and second shearing means for shearing said first and second shear pin means in sequence in response to the application of predetermined forces to the ski boot in a second direction resulting from predetermined torques to the ski boot.

33. The invention according to claim 23 wherein said ski binding includes structure for overlapping a portion of a ski boot disposed in the ski binding; and compressible boot supporting means having a boot engaging surface, a relaxed condition wherein said boot engaging surface is disposed close to said overlapping structure and a compressed condition wherein said boot engaging surface is disposed further from said overlapping structure; said boot supporting means being placed in the compressed condition when pressure from a ski boot is applied to said boot engaging surface to enable the portion of the ski boot to fit beneath said overlapping structure despite the presence of foreign matter on the bottom of the ski boot.

34. The invention according to claim 23 wherein said ski binding comprises boot supporting means for engaging the bottom of a ski boot disposed in the ski binding, said boot supporting means including a honeycomb structure having surfaces for removing foreign matter stuck to the bottom of the ski boot.

35. A ski binding for releasably securing a ski boot to a ski and for releasing the ski boot upon the application of predetermined forces to the ski boot, said ski binding comprising:

boot engaging means for engaging structure associated with a ski boot disposed in the ski binding for securing the ski boot to the ski; said boot engaging means comprising movable carriage means for carrying a boot engaging surface engageable with structure associated with a ski boot for retaining the ski boot in the ski binding when said carriage means is in said first position, and housing means for housing apparatus within said carriage means;

guide means for guiding said boot engaging means in a linear path on the ski between a first position wherein said boot engaging means secures the ski boot to the ski and a second position spaced from the ski boot wherein the boot engaging means does not secure the ski boot to the ski;

biassing means for urging said boot engaging means towards said second position, said biassing means comprising compression spring means compressible into said housing means for cocking said boot engaging means when said boot engaging means is in said first position.

latching means having a latching condition for retaining said boot engaging means in said first position against the bias of said biassing means, and an unlatching condition for releasing said boot engaging means to the bias of said biassing means; and unlatching means for placing said latching means in the unlatching condition in response to the application of said predetermined forces to the ski boot.

36. The invention according to claim 35 and further including:

cocking means for moving said boot engaging means from said second position to said first position and for compressing said compression spring means into said housing, said cocking means comprising cam means moveable over a predetermined path in engagement with said boot engaging means for moving said boot engaging means from said second position to said first position, and lever means connected to cam means for moving said cam means over said predetermined path.

37. The invention according to claim 35 and further including:

latch carriage means for carrying at least a portion of said latching means, said latch carriage means being connected to said boot engaging carriage means and mounted for linear movement on the ski in conjunction with the movement of said boot engaging carriage means between said first and second positions.

* * * * *